US008502437B2

(12) United States Patent
Tsai

(10) Patent No.: US 8,502,437 B2
(45) Date of Patent: Aug. 6, 2013

(54) LIGHT-EMITTING MODULE WITH COOLING FUNCTION

(75) Inventor: Chi-Tsung Tsai, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 13/204,807

(22) Filed: Aug. 8, 2011

(65) Prior Publication Data

US 2012/0286641 A1 Nov. 15, 2012

(30) Foreign Application Priority Data

May 9, 2011 (TW) ..... 100116145 A

(51) Int. Cl.
*H01J 1/02* (2006.01)

(52) U.S. Cl.
USPC ..... 313/46; 362/373

(58) Field of Classification Search
USPC ..... 313/46; 362/373
See application file for complete search history.

(56) References Cited

U.S. PATENT DOCUMENTS

| | | | | |
|---|---|---|---|---|
| 7,473,001 | B2 | 1/2009 | Schalkwijk et al. | |
| 7,607,803 | B2 | 10/2009 | Zhang et al. | |
| 7,753,556 | B1 | 7/2010 | Zhang et al. | |
| 8,193,688 | B2 * | 6/2012 | Chin | 313/46 |
| 2008/0043473 | A1 * | 2/2008 | Matsui | 362/294 |
| 2011/0019409 | A1 | 1/2011 | Wronski | |
| 2011/0156566 | A1 * | 6/2011 | Chen et al. | 313/46 |

FOREIGN PATENT DOCUMENTS

| | | |
|---|---|---|
| TW | I316121 | 10/2009 |
| TW | 201020457 | 6/2010 |

* cited by examiner

*Primary Examiner* — Mary Ellen Bowman
(74) *Attorney, Agent, or Firm* — Alan Kamrath; Kamrath IP Lawfirm, P.A.

(57) ABSTRACT

A light-emitting module with a cooling function includes a heat sink, a light-emitting element and a fitting member. The heat sink has a coupling face and at least one first assembling portion. The light-emitting element is coupled with the coupling face of the heat sink. The fitting member includes at least one positioning portion having at least one second assembling portion. The at least one second assembling portion is coupled with the at least one first assembling portion of the heat sink to position the light-emitting element between the at least one positioning portion and the heat sink.

26 Claims, 7 Drawing Sheets

LIGHT-EMITTING MODULE WITH COOLING FUNCTION

BACKGROUND OF THE INVENTION

1. Field of the Invention

The present invention generally relates to a light-emitting module with a cooling function and, more particularly, to a light-emitting module equipped with a heat sink for cooling purposes.

2. Description of the Related Art

Referring to FIG. 1, Taiwanese Patent No. 1316121 discloses a conventional lamp 8 with a housing 81. The conventional lamp 8 consists of an air outlet portion 811 and an air inlet portion 812. The housing 81 receives a light-emitting module 82 with a cooling function that consists of a heat sink 821, a light-emitting element 822 and a cooling fan 823. The light-emitting element 822 and the cooling fan 823 can be coupled with the heat sink 821. Based on the structure, the cooling fan 823 may draw air into the conventional lamp 8 via the air inlet portion 812. The drawn air will flow past the heat sink 821 and be expelled via the air outlet portion 811. Utilization of the heat sink 821 can facilitate dissipating the heat generated by the light-emitting element 822 and can increase service life of the light-emitting element 822.

The light-emitting element 822 of the light-emitting module 82 is usually coupled with the heat sink 821 for cooling purposes. Due to a variety of shapes and sizes available for the light-emitting element 822, however, different light-emitting element 822 should be mounted on different heat sinks 821 whose assembling holes are aligned with the assembling holes of the light-emitting element 822 for assembly purposes. Therefore, different molds should be prepared to manufacture different heat sinks 821 for all kinds of light-emitting elements 822, leading to an increased cost.

FIG. 2 shows another conventional light-emitting module 9 with a cooling function. The conventional light-emitting module 9 has a light-emitting element 91 mounted on a heat sink 93 via a connection board 92. In this arrangement, the connection board 92 is disposed between the light-emitting element 91 and the heat sink 93. The connection board 92 has a plurality of assembling holes 921 that must be aligned with a plurality of assembling holes 931 of the heat sink 93 for assembling purposes. In this regard, when it is desired to mount another light-emitting element 91 with a different shape and size on the heat sink 93, the only component that should be changed is the connection board 92 rather than the heat sink 93 (note the assembling holes 921 of the new connection board 92 have to align with the assembling holes 931 of the heat sink 93 for assembly purposes). This mechanism allows different light-emitting elements 91 to be assembled to the heat sink 93 without making a new mold for the heat sink 93 as required by the conventional lamp 8. Since the connection board 92 has a much lower cost than the heat sink 93, the cost of the conventional light-emitting module 9 can be significantly reduced.

However, the heat generated by the light-emitting element 91 cannot be efficiently delivered to the heat sink 93, because the light-emitting element 91 is indirectly mounted on the heat sink 93 via the connection board 92. As a result, the cooling effect is limited. Furthermore, since a heat-conducting medium 94 such as a thermal paste can be arranged between the light-emitting element 91 and the heat sink 93 for better heat conduction, both faces of the connection board 92 should be coated with the heat-conducting medium 94, and an increased cost, therefore, results resulted.

SUMMARY OF THE INVENTION

It is therefore the primary objective of this invention to provide a light-emitting module with a cooling function which can be equipped with different light-emitting elements without changing its heat sink.

It is another objective of this invention to provide a light-emitting module with a cooling function which allows its light-emitting element to directly contact a heat sink for improved cooling efficiency.

The invention discloses a light-emitting module with a cooling function, which includes a heat sink, a light-emitting element and a fitting member. The heat sink has a coupling face and at least one first assembling portion. The light-emitting element is coupled with the coupling face of the heat sink. The fitting member includes at least one positioning portion having at least one second assembling portion. The at least one second assembling portion is coupled with the at least one first assembling portion of the heat sink to position the light-emitting element between the at least one positioning portion and the heat sink.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
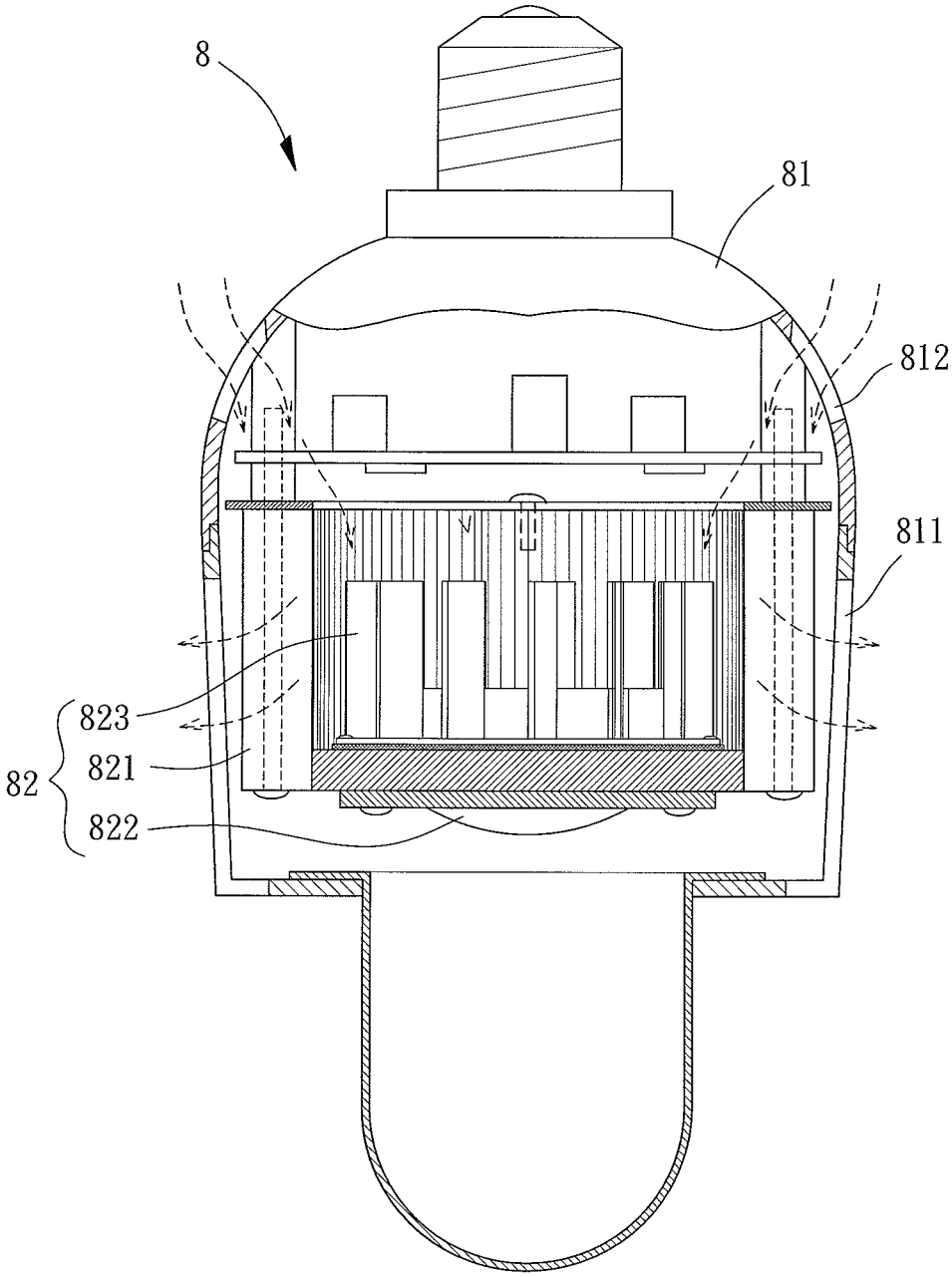
FIG. 1 PRIOR ART
FIG. 1 shows a cross-sectional diagram of a conventional lamp.
Figure 2:
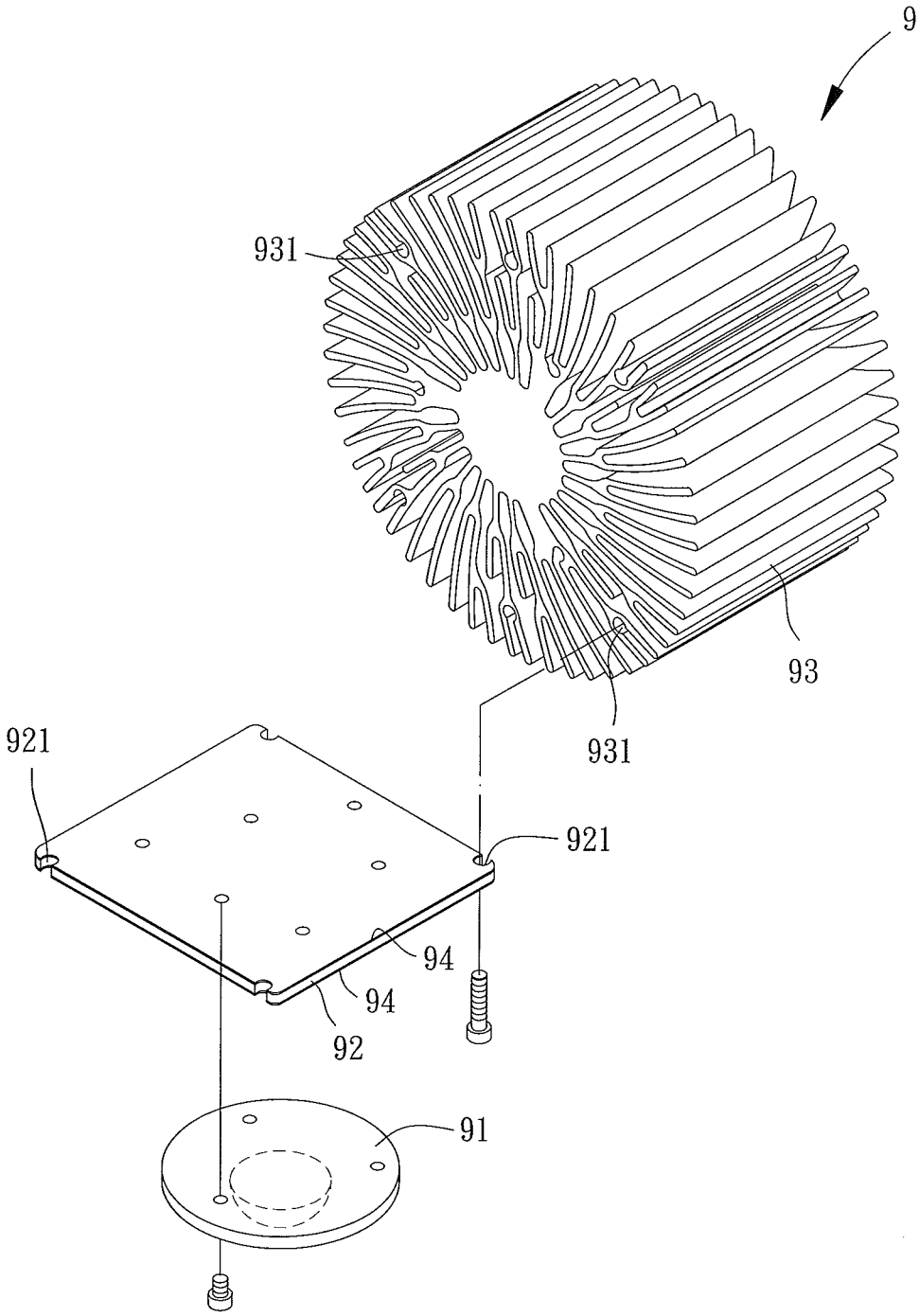
FIG. 2 PRIOR ART
FIG. 2 shows an exploded diagram of a conventional light-emitting module with a cooling function.

In the various figures of the drawings, the same numerals designate the same or similar parts. Furthermore, when the terms "first", "second", "third", "fourth", "inner", "outer" "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
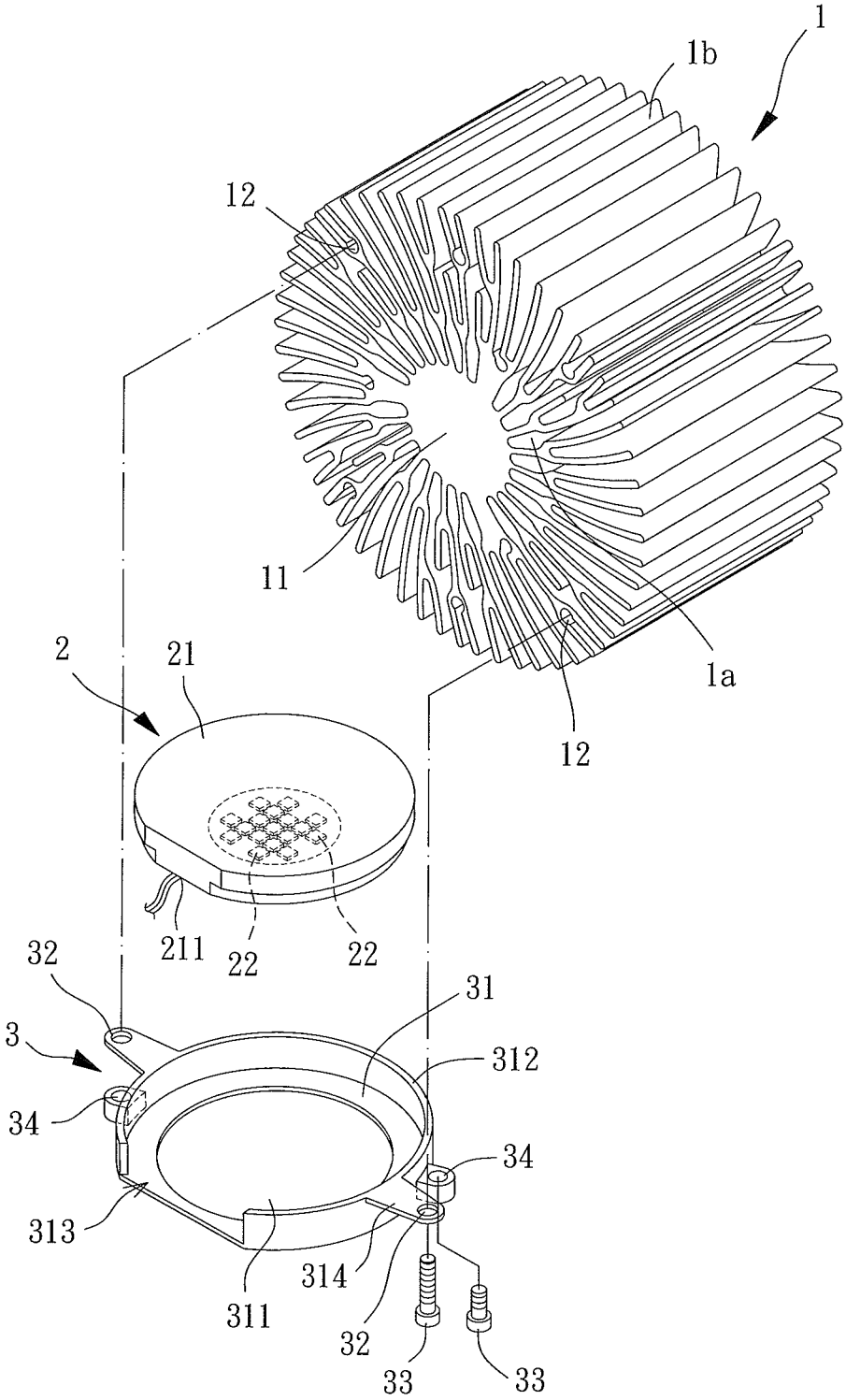
FIG. 3 shows an exploded diagram of a light-emitting module with a cooling function according to an embodiment of the invention.
Figure 4:
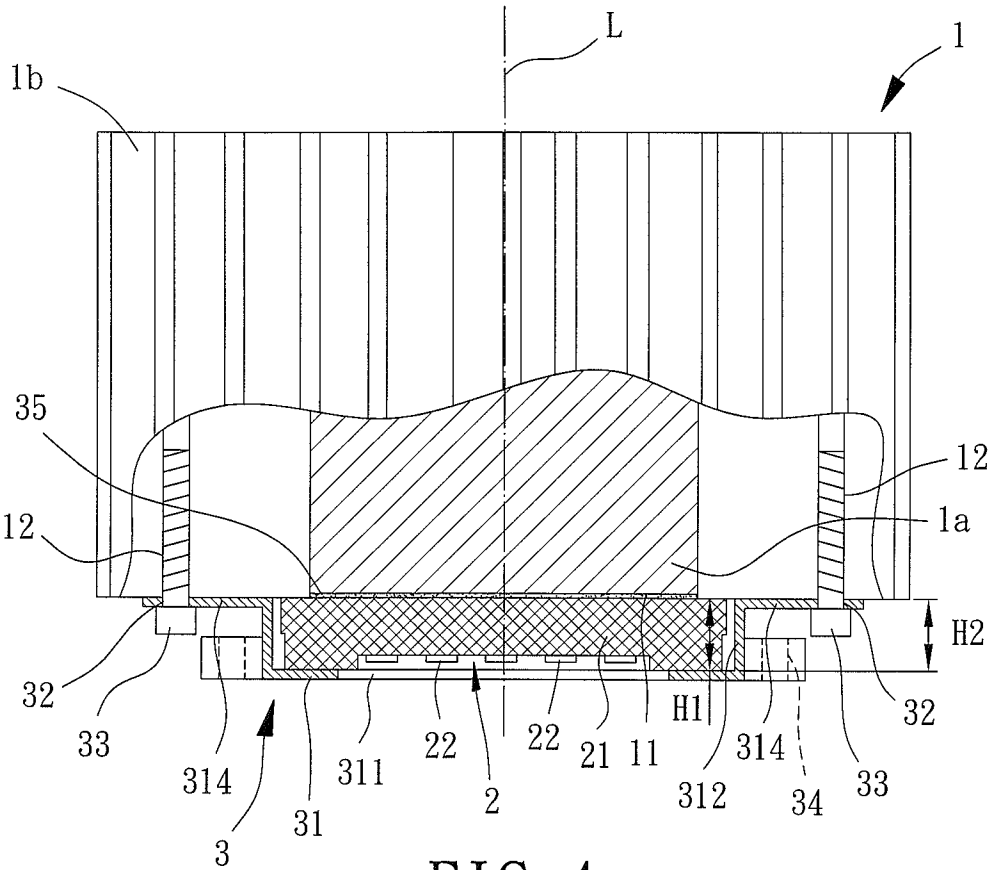
FIG. 4 shows a cross-sectional diagram of the light-emitting module of the invention after assembly.

Referring to FIGS. 3 and 4, a light-emitting module including a heat sink 1, a light-emitting element 2 and a fitting member 3 is disclosed according to an embodiment of the invention. The heat sink 1 is coupled with the light-emitting element 2, and the fitting member 3 is fitted around the light-emitting element 2. In this arrangement, the light-emitting element 2 is positioned between the heat sink 1 and the fitting member 3.

The heat sink 1 can be made of any material with heat conductivity and is of various shapes, such as a circular shape or a polygonal shape. The heat sink 1 has a coupling face 11 and at least one first assembling portion 12. In this embodiment, the at least one first assembling portion 12 is implemented as a plurality of first assembling portions 12 surrounding the coupling face 11. The first assembling portions 12 can be of any structure that can combine with the fitting member 3 by way of, for example, screwing, fastening or fixing.

The heat sink 1 further includes a central pole 1*a* having one end face being the coupling face 11, as well as a plurality of fins 1*b* on an outer circumferential wall thereof. The fins 1*b* can increase the heat exchange area of the heat sink 1. In addition, several of the fins 1*b* jointly form the first assembling portions 12 to allow assembly and disassembly between the heat sink 1 and the fitting member 3. Note each first assembling portion 12 is in the form of a through-hole.

The light-emitting element 2 is coupled with the coupling face 11 of the heat sink 1 and can be a light-emitting diode (LED) module, a bulb or the like. In this embodiment, the light-emitting element 2 is implemented as the LED module for longer service life and power saving. The light-emitting element 2 includes a base plate 21. The base plate 21 has one face mounted with a plurality of light-emitting diodes (LEDs) 22, as well as the other face coupled with the coupling face 11 of the heat sink 1. In this arrangement, the heat sink 1 can efficiently reduce the heat generated by the LEDs 22. Moreover, the base plate 21 further includes an electrical connection portion 211 on a periphery thereof for connecting to an external power or a controller, to control operation of the light-emitting element 2.

The fitting member 3 includes at least one positioning portion 31. In this embodiment, the at least one positioning portion 31 is a single positioning portion 31 as shown in FIG. 3. The positioning portion 31 has at least one second assembling portion 32. In this embodiment, the at least one second assembling portion 32 includes a plurality of second assembling portions 32 corresponding to the first assembling portions 12. The second assembling portions 32 can be coupled with the first assembling portions 12 of the heat sink 1 to position the light-emitting element 2 between the positioning portion 31 and the heat sink 1. In this arrangement, the light-emitting element 2 can firmly couple with the coupling face 11 of the heat sink 1. The positioning portion 31 of the fitting member 3 is preferably in the form of a plate made of heat-conducting material, such as metal with heat conductivity. Based on this, the positioning portion 31 can facilitate delivering the heat of the light-emitting element 2 to the heat sink 1 by its heat conductivity. Thus, the light-emitting module of the invention may have a better heat-conducting effect.

Based on the above concepts, the fitting member 3 of the invention may have different implementations for further improvement, as described below.

In a first implementation, the positioning portion 31 of the fitting member 3 is implemented as a single plate having a central hole 311. As such, when the light-emitting element 2 is coupled with the fitting member 3, the base plate 21 of the light-emitting element 2 can be wrapped around by the positioning portion 31 while the LEDs 22 on the base plate 21 are located at the central hole 311 to emit light through the central hole 311. The positioning portion 31 further includes a lateral wall 312 axially extending from a periphery thereof to prevent disengagement of the light-emitting element 2. The lateral wall 312 has a cut-off portion 313 aligned with the electrical connection portion 211 when the light-emitting element 2 is coupled with the fitting member 3. Arrangement of the cut-off portion 313 allows one to connect the electrical connection portion 211 of the light-emitting element 2 to the external power or controller for convenient assembly.

Referring to FIGS. 3 and 4, the lateral wall 312 has a periphery forming at least one flange portion 314. In this embodiment, the at least one flange portion 314 is implemented as a plurality of flange portions 314 corresponding to the second assembling portions 32. Each second assembling portion 32 is in the form of a through-hole formed on a respective flange portion 314. Thus, when the first assembling portions 12 are aligned with the second assembling portions 32, a plurality of fixing members 33 such as screws may be used to extend through the first and second assembling portions 12 and 32 to fix the fitting member 3 and the heat sink 1 together. In this way, the light-emitting element 2 may be positioned between the fitting member 3 and the heat sink 1, thereby enhancing the coupling between the light-emitting element 2 and the fitting member 3.

Figure 5:
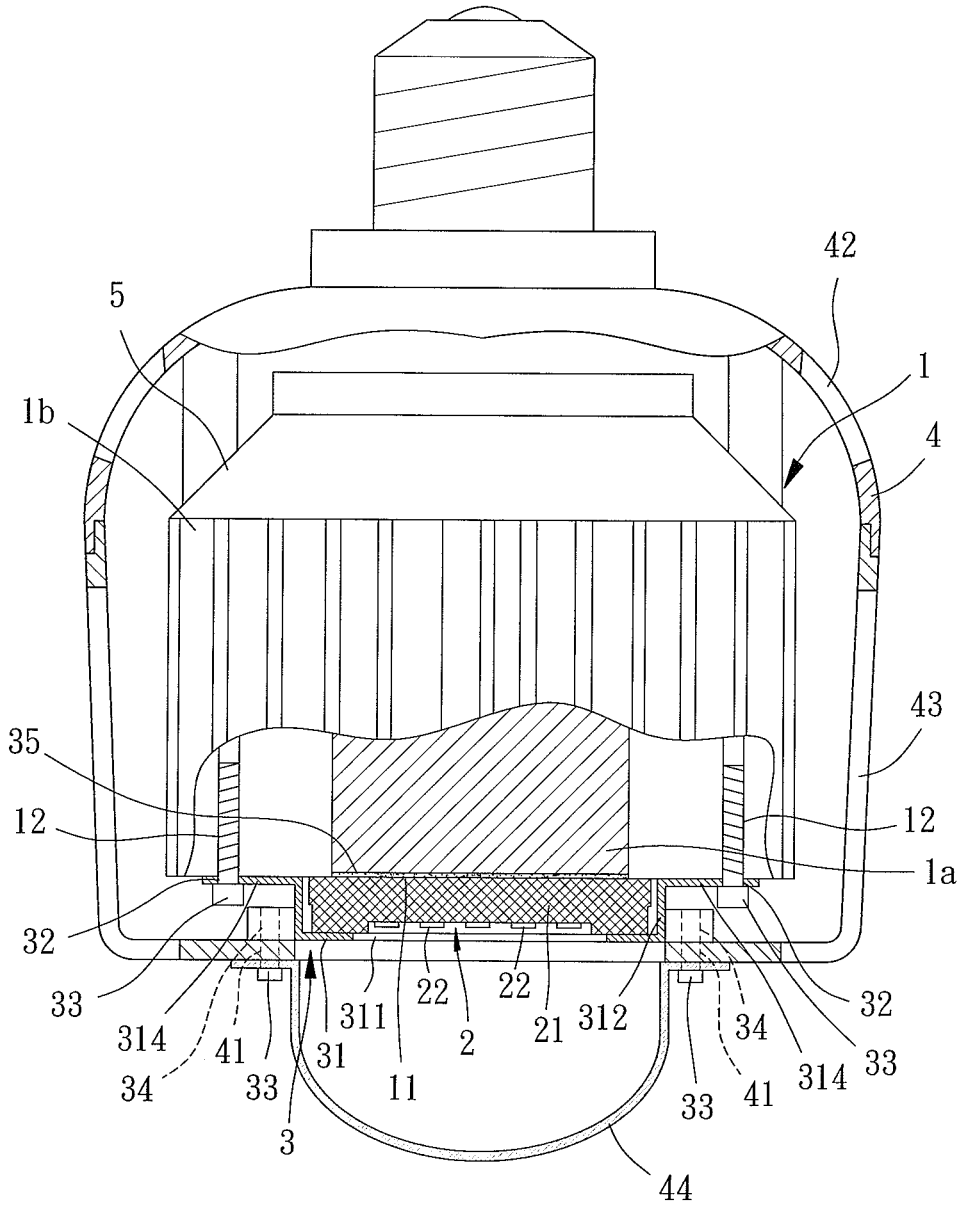
FIG. 5 shows a cross-sectional diagram of the light-emitting module of the invention that is assembled with a bulb.

Referring to FIGS. 3 and 5, the fitting member 3 may farther include a plurality of assembling holes 34 on a periphery of the positioning portion 31. Accordingly, the light-emitting module of the invention may further include a housing 4 having a plurality of through-holes 41. Based on the structure, a plurality of fixing members 33 such as screws may extend through the through-holes 41 of the housing 4 to fix with the assembling holes 34 of the fitting member 3. This allows the heat sink 1 and the light-emitting element 2 to be disposed in the housing 4 by, for example, screwing the fitting member 3 to the housing 4. Therefore, the housing 4 can provide protection for the heat sink 1 and the light-emitting element 2. Further, the heat sink 1 may be coupled with a cooling fan 5, and the housing 4 may further include an air inlet 42 and an air outlet 43. The cooling fan 5 may draw air into the housing 4 via the air inlet 42. The drawn air will flow past the heat sink 1 and be expelled from the housing 4 via the air outlet 43. Thus, heat generated by the light-emitting element 2 can be dissipated, and the service life thereof is therefore increased. Moreover, referring to FIG. 5 again, the fitting member 3 may be coupled with a bulb 44 via the fixing members 33 extending through the assembling holes 34 of the positioning portion 31. The bulb 44 can enhance the light projection effect of the light-emitting element 2.

Referring to FIG. 4, the heat sink 1 can be defined with an axial reference line L. The light-emitting element 2 has a first height H1 along the axial reference line L, and the lateral wall 312 of the fitting member 3 has a second height H2 along the axial reference line L, with the second height 1-12 being equal to or slightly smaller than the first height H1. As such, the positioning portion 31 may firmly press the light-emitting element 2 to position the light-emitting element 2 between the fitting member 3 and the heat sink 1, preventing undesired movement of the light-emitting element 2. Alternatively, a buffering member (such as a rubber pad) may be arranged between the light-emitting element 2 and the fitting member 3 to fill a potential gap between the light-emitting element 2 and the fitting member 3. This also provides good positioning effect for the light-emitting element 2.

Referring to FIG. 4, one face of the light-emitting element 2 facing the heat sink 1 can be coated with a heat-conducting medium 35 such as a thermal paste to facilitate delivering the heat of the light-emitting element 2 to the heat sink 1 for an improved heat conduction effect.

Figure 6:
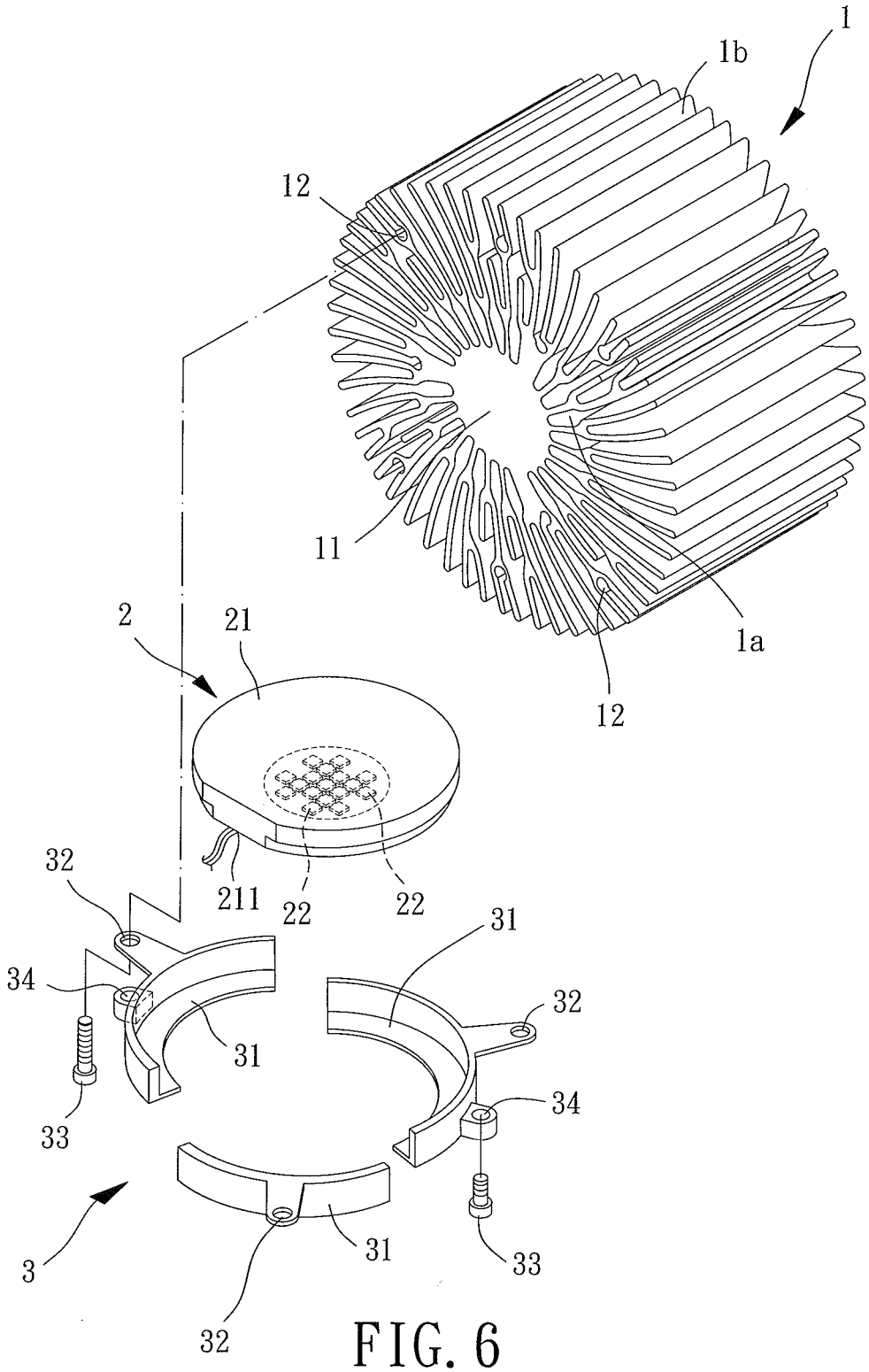
FIG. 6 shows an implantation of a fitting member of the light-emitting module of the invention.

In another embodiment shown in FIG. 6, the at least one positioning portion 31 of the fitting member 3 is implemented as a plurality of positioning portions 31. Each positioning portion 31 has a second assembling portion 32 arranged on a periphery thereof In such an arrangement, the second assembling portions 32 of the positioning portions 31 can also be assembled to the first assembling portions 12 of the heat sink 1. Thus, the positioning portions 31 can couple the light-emitting element 2 with the heat sink 1 to position the light-emitting element 2 between the fitting member 3 and the heat sink 1.

Based on the structures previously disclosed, the light-emitting module with a cooling function has the following advantages.

First, when it is desired to mount another light-emitting element 2 with a different shape and size on the heat sink 1, it is only needed to replace the fitting member 3 with a new one suitable for the light-emitting element 2. Note that the second assembling portions 32 of the new fitting member 3 must be aligned with the first assembling portions 12 of the heat sink 1, such that the light-emitting element 2 can be positioned between the new fitting member 3 and the heat sink 1. Since the fitting member 3 has a much lower cost than the heat sink 1, the cost of the light-emitting module of the invention can be significantly reduced.

Second, as opposed to the conventional light-emitting module 9 which requires changing the connection board 92 when it is desired to mount different light-emitting element 91 (with different shape and size) on the heat sink 93, the invention does not need to change the fitting member 3 under a condition where the fitting member 3 does not have a big size difference from a new light-emitting element 2 to be mounted on the heat sink 1. This is because the fitting member 3, which does not have a big size difference from the new light-emitting element 2, can still position the new light-emitting element 2 efficiently. Thus, the light-emitting module of the invention can have lower costs.

Figure 7:
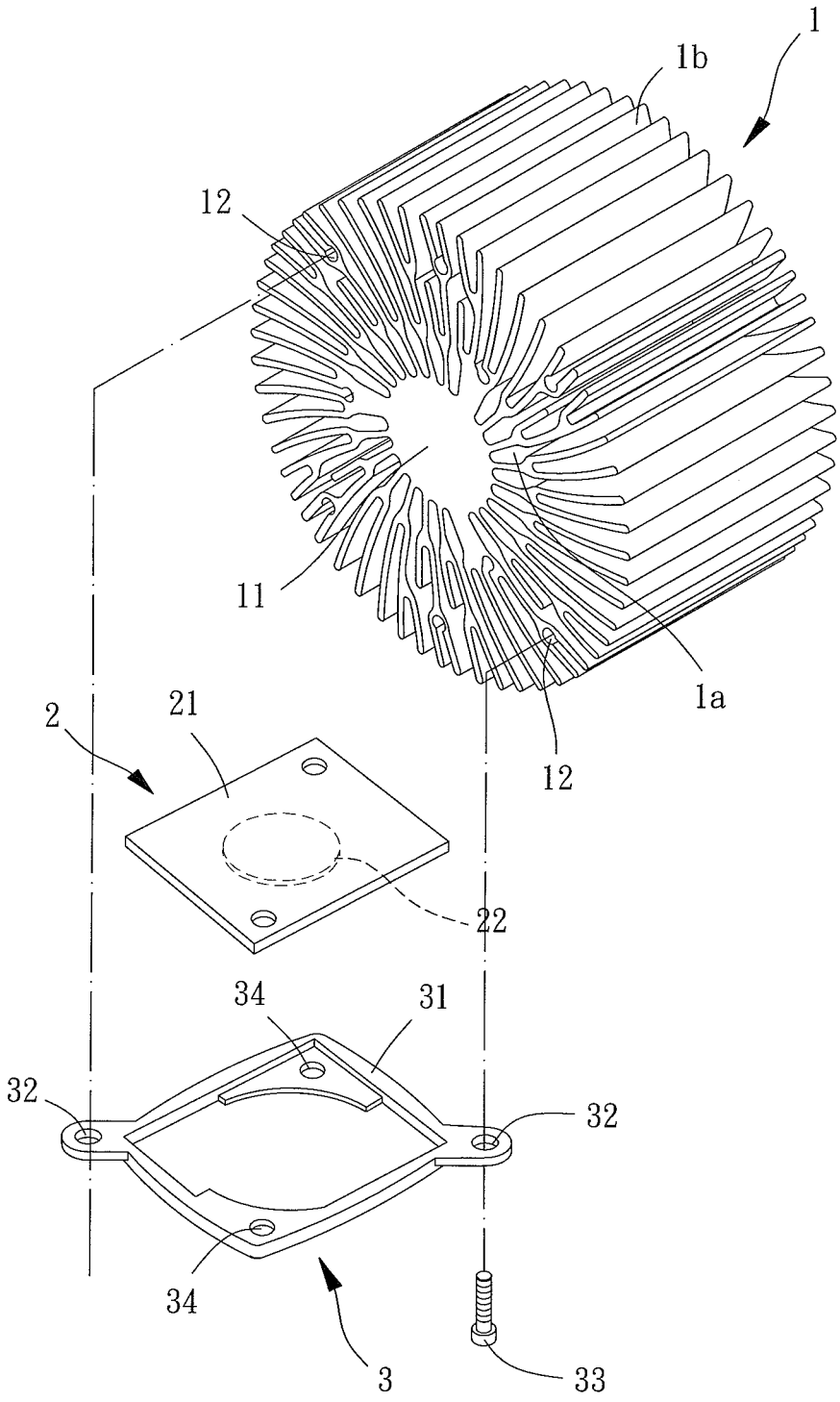
FIG. 7 shows an exploded diagram of a light-emitting module having a same heat sink coupled with another light-emitting element with a different shape and size, with a fitting member of the light-emitting module having been changed to a new one fitted to the light-emitting element.

Referring to FIG. 7, a light-emitting module is shown to have the same heat sink 1 coupled to another light-emitting element 2 with a rectangular shape. In this case, the fitting member 3 has been replaced with a new one having the rectangular shape. Thus, the same heat sink 1 can still be used when the light-emitting element 2 is changed.

More importantly, the invention allows the light-emitting element 2 to direct contact with the heat sink 1. Thus, heat of the light-emitting element 2 can be easily delivered to the heat sink 1, thereby improving the overall cooling efficiency of the light-emitting module and attaining a longer service life of the light-emitting module.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A light-emitting module with a cooling function, comprising:

a heat sink having a coupling face and at least one first assembling portion;

a light-emitting element coupled with the coupling face of the heat sink and having a first height along an axial reference line; and a fitting member including at least one positioning portion, a lateral wall, and at least one second assembling portion, with the at least one positioning portion having an outer periphery and an inner periphery defining a central hole, with the light-emitting element abutting with the at least one positioning portion between the inner and outer peripheries, with the lateral wall axially extending from the outer periphery towards the heat sink to a free edge, with the lateral wall having a second height along the axial reference line between the free edge and the outer periphery, with the at least one second assembling portion located on the lateral wall, wherein the at least one second assembling portion is coupled with the at least one first assembling portion of the heat sink, the free edge abutting with the heat sink, and the second height is equal to or smaller than the first height to position the light-emitting element between the at least one positioning portion and the heat sink and with the light-emitting element being accessible through the central hole.

2. The light-emitting module with a cooling function as claimed in claim 1, wherein one face of the light-emitting element facing the heat sink is coated with a heat-conducting medium.

3. The light-emitting module with a cooling function as claimed in claim 1, wherein the light-emitting element includes a base plate, and wherein the base plate has one face mounted with one or more light-emitting diodes and another face coupled with the coupling face of the heat sink.

4. The light-emitting module with a cooling function as claimed in claim 3, wherein the at least one positioning portion of the fitting member is in the form of a single plate having the central hole, the base plate of the light-emitting element is wrapped around by the single plate, and the one or more light-emitting diodes are located at the central hole.

5. The light-emitting module with a cooling function as claimed in claim 4, wherein the base plate of the light-emitting element includes an electrical connection portion on a periphery of the base plate, the single plate includes the lateral wall axially extending from the outer periphery of the single plate of the at least one positioning portion, and the lateral wall has a cut-off portion aligned with the electrical connection portion of the light-emitting element.

6. The light-emitting module with a cooling function as claimed in claim 5, wherein the lateral wall has a periphery forming a plurality of flange portions, the at least one second assembling portion is formed as a plurality of through-holes on the plurality of flange portions, the at least one first assembling portion of the heat sink is in the form of a plurality of through-holes, and the plurality of through-holes of the first and second assembling portions are aligned with each other and extended through by a plurality of fixing members.

7. The light-emitting module with a cooling function as claimed in claim 1, wherein the second height is smaller than the first height.

8. The light-emitting module with a cooling function as claimed in claim 7, further comprising a buffering member arranged between the light-emitting element and the fitting member.

9. The light-emitting module with a cooling function as claimed in claim 1, wherein the lateral wall has a periphery forming a plurality of flange portions, the at least one second assembling portion is formed as a plurality of through-holes on the plurality of flange portions, the at least one first assembling portion of the heat sink is in the form of a plurality of through-holes, and the plurality of through-holes of the first and second assembling portions are aligned with each other and extended through by a plurality of fixing members.

10. The light-emitting module with a cooling function as claimed in claim 1, further comprising a buffering member arranged between the light-emitting element and the fitting member.

11. The light-emitting module with a cooling function as claimed in claim 1, wherein the heat sink further includes a central pole having one end face being the coupling face, and a plurality of fins on an outer circumferential wall of the central pole.

12. The light-emitting module with a cooling function as claimed in claim 1, further comprising a housing having a plurality of through-holes, wherein the fitting member has a plurality of assembling holes on the outer periphery of the at least one positioning portion, and a plurality of fixing members is extended through the plurality of through-holes of the housing to fix with the plurality of assembling holes of the fitting member, with the heat sink and the light-emitting element disposed in the housing by the fitting member.

13. The light-emitting module with a cooling function as claimed in claim 12, wherein the heat sink is coupled with a cooling fan, and the housing further includes an air inlet and an air outlet.

14. A light-emitting module with a cooling function comprising:

a heat sink having a coupling face and a plurality of first assembling portions;

a light-emitting element coupled with the coupling face of the heat sink; and a fitting member including a plurality of positioning portions, a plurality of lateral walls, and a plurality of second assembling portions, wherein the plurality of second assembling portions are assembled to the plurality of first assembling portions of the heat sink to position the light-emitting element between the plurality of positioning portions and the heat sink, with the plurality of positioning portions having an outer periphery and an inner periphery defining a central hole, with the plurality of lateral walls axially extending from the outer periphery of the plurality of positioning portions towards the heat sink, wherein the plurality of positioning portions and the plurality of lateral walls are circumferentially divided around the central hole into separate components, wherein each of the plurality of positioning portions has a respective one of the plurality of lateral walls arranged on the outer periphery thereof, wherein each of the plurality of positioning portions further has a respective one of the plurality of second assembling portions located on the respective one of the plurality of lateral walls, with the light-emitting element abutting with the plurality of positioning portions between the inner and outer peripheries, and with the light-emitting element being accessible through the central hole.

15. The light-emitting module with a cooling function as claimed in claim 1, wherein the fitting member has a plurality of assembling holes on the outer periphery of the at least one positioning portion, and the fitting member is coupled with a bulb via a plurality of fixing members extending through the plurality of assembling holes of the at least one positioning portion.

16. The light-emitting module with a cooling function as claimed in claim 1, wherein the at least one positioning portion of the fitting member is made of heat-conducting material.

17. The light-emitting module with a cooling function as claimed in claim 14, wherein one face of the light-emitting element facing the heat sink is coated with a heat-conducting medium.

18. The light-emitting module with a cooling function as claimed in claim 14, wherein the light-emitting element includes a base plate, and wherein the base plate has one face mounted with one or more light-emitting diodes and another face coupled with the coupling face of the heat sink.

19. The light-emitting module with a cooling function as claimed in claim 18, wherein the base plate of the light-emitting element includes an electrical connection portion on a periphery of the base plate, and wherein one of the plurality of lateral walls has a cut-off portion aligned with the electrical connection portion of the light-emitting element.

20. The light-emitting module with a cooling function as claimed in claim 19, wherein the fitting member further includes a plurality of flange portions, each of the plurality of lateral walls has a periphery forming a respective one of the plurality of flange portions, the plurality of second assembling portions are formed as a plurality of through-holes on the plurality of flange portions, the plurality of first assembling portions of the heat sink are in the form of a plurality of through-holes, and the plurality of through-holes of the plurality of first and second assembling portions are aligned with each other and extended through by a plurality of fixing members.

21. The light-emitting module with a cooling function as claimed in claim 14, further comprising a buffering member arranged between the light-emitting element and the fitting member.

22. The light-emitting module with a cooling function as claimed in claim 14, wherein the heat sink further includes a central pole having one end face beingthe coupling face, and a plurality of fins on an outer circumferential wall of the central pole.

23. The light-emitting module with a cooling function as claimed in claim 14, further comprising a housing having a plurality of through-holes, wherein the fitting member has a plurality of assembling holes on the outer periphery of the plurality of positioning portions, and a plurality of fixing members is extended through the plurality of through-holes of the housing to fix with the plurality of assembling holes of the fitting member, with the heat sink and the light-emitting element disposed in the housing by the fitting member.

24. The light-emitting module with a cooling function as claimed in claim 23, wherein the heat sink is coupled with a cooling fan, and the housing further includes an air inlet and an air outlet.

25. The light-emitting module with a cooling function as claimed in claim 14, wherein the fitting member has a plurality of assembling holes on the outer periphery of the plurality of positioning portions, and the fitting member is coupled with a bulb via a plurality of fixing members extending through the plurality of assembling holes of the plurality of positioning portions.

26. The light-emitting module with a cooling function as claimed in claim 14, wherein the plurality of positioning portions of the fitting member are made of heat-conducting material.

* * * * *